United States Patent [19]

Rossi

[11] 4,456,036

[45] Jun. 26, 1984

[54] WIRE BENDING APPARATUS AND A METHOD OF BENDING A WIRE

[75] Inventor: Piergiorgio Rossi, Claro, Switzerland

[73] Assignee: Oemb SA, Bodio, Switzerland

[21] Appl. No.: 442,742

[22] Filed: Nov. 18, 1982

[30] Foreign Application Priority Data

Nov. 18, 1981 [CH] Switzerland ..... 7413/81

[51] Int. Cl.[3] ..... B21F 1/00

[52] U.S. Cl. ..... 140/105; 83/580

[58] Field of Search ..... 140/102, 105; 72/387, 72/388, 307, 332, 338; 83/580

[56] References Cited

U.S. PATENT DOCUMENTS 4,049,026 9/1977 Del Fabro ..... 140/105

4,248,273 2/1981 Marcello ..... 140/105

*Primary Examiner*—Francis S. Husar

*Assistant Examiner*—Linda McLaughlin

*Attorney, Agent, or Firm*—Ladas & Parry

[57] ABSTRACT

In order to allow an adjusting of the bending tools to a given diameter of the wire being bent allowing the producing of the requisite bending radius a central mandrel which forms two bending or forming, respectively, jaws is replaceable together with a shearing tool. To this end a hollow shaft is mounted at the rear of the central mandrel, which shaft is mounted to a supporting shaft by means of a screw joint. The supporting shaft is supported in turn rotationally and can be rotated by means of a motor in order to disconnect the central mandrel. By mentioned rotation the screw joint is released. A special coupling of the shearing tool to an axially movable operating shaft allows a simultaneous disconnecting of the shearing tool together with the central mandrel. A bending mandrel is mountable at locations having various radial distances from the central mandrel. A cover plate provided with a position control element operates together with proximity switches such that two defined initial angular positions of the bending mandrel is maintained independently from mentioned adjustments.

8 Claims, 49 Drawing Figures

11
19
20
18
21
17
9
8
8
16
13
15
6
4
30
12
10
3
1
2
14
5
29
II
III
III
II 32
31
3
29
32
30
36
36
2
12
2
26
10
28
14
1
5
33
33

3
1
36
2
5
35
34

3
2
4
6

2
3
4
6

2
3
4
6

2
3
4
6
12

WIRE BENDING APPARATUS AND A METHOD OF BENDING A WIRE

BACKGROUND OF THE INVENTION

1. Field of the Invention

The present invention relates to an improved wire-bending apparatus including a central mandrel which is intended to control the axis of the bends and the radius of curvature of the bent wire, including further a shearing means located within said central mandrel and a retractable and extendable bending mandrel movable by means of a bending table along a circular curve extending around said central mandrel.

2. Description of the Prior Art

A wire-bending apparatus of the kind mentioned is disclosed in the Swiss Pat. No. CH-A-592 481. The apparatus disclosed therein has a specific drawback in that the bending mechanism is not adjustable to various cross sections of wires or bars, respectively, such as is, for instance, necessary when bending reinforcing bars in accordance with the SIA-standards. Such reinforcing bars are used, for instance, for reinforced concrete structures. A speedy changing of the operation to cope with various cross sections of bars is, however, a necessity for an economic operation of such apparatuses.

SUMMARY OF THE INVENTION

Hence, it is a general object of the present invention to provide an improved wire-bending apparatus of the kind referred to which allows a speedy adjusting of the individual structural elements thereof and of the operation thereof to the prevailing material which must be handled.

A further object is to provide an improved wire-bending apparatus, in which the central mandrel and the shearing means form together an exchangeable unit such to cope with various wire cross sections and various radii of curvature.

A further object is to provide an improved wire-bending apparatus, in which the radial position of the bending mandrel located on a bending plate is adjustable and in which the bending table is provided with a plurality of openings for receipt of a bending mandrel, which openings are distributed in the bending table at various radial distances.

A further object is to provide an improved wire-bending apparatus, which comprises a cover plate located over a bending table, which cover plate has a radially extending opening for receipt of a bending mandrel, and which cover plate comprises further a position control element which allows a presetting of the angular position of the bending mandrel, and which apparatus is provided with two stationary sensors which are controlled by the position control element such that at any radial position of the bending mandrel one each initial angular position may be set at both sides of a wire feed means at the wire-bending apparatus. A further object is to provide a method of bending a wire by means of a wire-bending apparatus in which after the execution of one wire-bending operation the bending mandrel is returned simultaneously with a wire feeding movement into a retracted state into one of two initial angular positions.

A further object is a method according to which independently from a prevailing cross section of the iron being bent a correct returning of the bending mandrel automatically into the correct initial position for a subsequent bending is achieved. An adjusting of the structural elements of the apparatus in accordance with the workpiece to be handled does not necessitate a new adjusting thereof.

BRIEF DESCRIPTION OF THE DRAWINGS

The invention will be better understood and objects other than those set forth above will become apparent when consideration is given to the following detailed description thereof. Such description makes reference to the annexed drawings, wherein:

FIG. 3 is a partly schematically drawn, partly sectional view along line III—III of FIG. 1;

DETAILED DESCRIPTION OF THE PREFERRED EMBODIMENT

Figure 1:
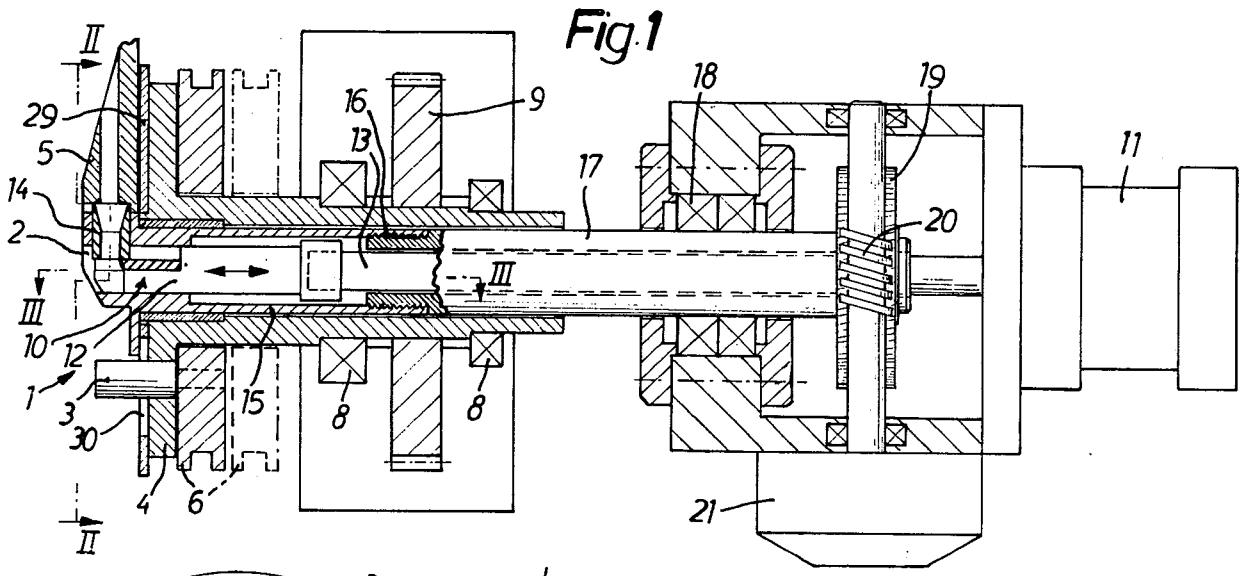
FIG. 1 is a partly schematic, partly sectional view of the main parts of a wire-bending machine of which the section extends in a plane extending through the wire feed means and the axis of rotation of the bending table.
Figure 2:
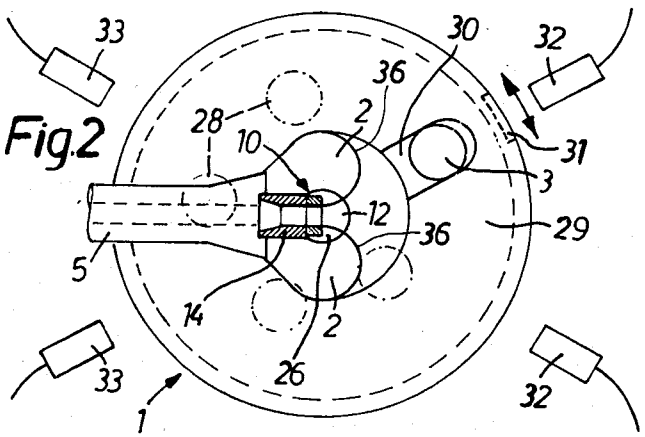
FIG. 2 is a view shown partly in section along line II—II of FIG. 1.

Describing now the drawings and considering initially the preferred embodiment of the wire-bending machine shown in FIGS. 1 and 2 it will be understood that same comprises a stationary wire feed channel 5 mounted rigidly to the frame of the apparatus, to which wire feed channel 5 a wire having been straightened previously is fed to the bending and shearing means 1. A central mandrel 2 is provided therein, which defines at both sides seen relative to the direction of wire feed shaping jaws 36, which shaping jaws 36 define the radius of curvature as well as the bending axis for every bend to be made. By means of a driven bending table 4 a bending mandrel 3 is rotatable relative to the direction of wire feed about 180° each in a clockwise and a counterclockwise direction. This bending mandrel 3 projects through the bending table 4 and is screwed into a mounting plate 6 located behind the bending table 4. This mounting plate 6 is axially movable in guide members 7 (see FIG. 3) relative to the bending table 4 into a position shown in FIG. 1 with interrupted lines, with which movement the bending mandrel 3 is retractable from its operating position. The axial shifting movement of the mounting plate 6 is achieved by a not specifically shown lever and linkage arrangement which is oil-hydraulically driven.

The torsional moment necessary for bending the workpiece is exerted by the bending table 4 onto the bending mandrel 3. To this end the bending table 4 is provided with a rear projection in the shape of a hollow cylinder and a driving gear 9 is located thereupon and between bearings 8, which driving gear 9 is driven by the agency of a not specifically shown generally known kinematic chain. This allows the bending mandrel to move circularly as well as carry out independently therefrom a retracting and extending movement. This feature will be explained later on by reference to FIG. 5.

A shearing and ejection device or shearing means 10 is located within the central mandrel 2, which shearing and ejection device 10 is provided with a shearing tool 12 which is movable in axial direction and at a predetermined stroke, which shearing tool 12 is driven via an operating rod 13 by a hydraulic cylinder 11 (FIG. 1). The shearing tool 12 which has a reinforced planar shearing surface cooperates with a sleeve 14 located in the central mandrel 2, which sleeve 14 is structured on the one hand as a wire guide means and on the other hand as a counterknife. As will be explained more in detail later on with reference to FIG. 5, this central location of the shearing means 10 is advantageous because in order to shape the last section of a completely bent wire bracket no reverse feed of the wire is necessary if short end sections must be shaped, which reverse feed is necessary in the bending apparatuses constructed in accordance with the prior art and comprise a shearing means located in front of the bending point. Furthermore, a central location of the shearing means did exclude until now the possibility of adjusting the wire-bending machine to prevailing demands.

The radii of the bends which to the largest extent are set by the shape of mentioned shaping jaws of the central mandrel 2 must be adjustable depending from the prevailing diameter of the wire or bar, respectively, (see the respective SIA-standards). Mentioned adjustability of the wire-bending apparatus necessitates therefore among other things an easy exchangeability of the central mandrel 2, within which the shearing means 10 is located as explained earlier. To this end the central mandrel is provided with a hollow shaft 15 located at its rear such as is shown in FIGS. 2 and 3. The rear end of this hollow shaft 15 comprises a thread 16, which engages into a corresponding counterthread located on a supporting shaft 17. This supporting shaft 17 which is rotatably supported in bearings 18 comprises a worm gear 19, which is driven by a drive motor 21 via a worm 20 (see FIG. 1). A further embodiment foresees a crank handle which allows a manual rotating of worm 20. If the central mandrel is to be exchanged, the drive motor 21 is energized or the crank handle rotated, respectively, such to rotate the supporting shaft 17. Because now the central mandrel and accordingly the hollow shaft 15 are held against rotation in the wire feed channel 5, but axially movable relatively thereto, the screw joint between supporting shaft 17 and hollow shaft 15 will be released and the central mandrel 2 will move outwards. The shearing tool 12 is now mounted such to the operating rod 13 (FIG. 3) that it is also disconnected and may be removed together with the central mandrel at its front side. To this end the shearing tool 12 is backwardly biassed by means of a spring 22. Its connection to the operating rod 13 is maintained by radially movable bolts 23, which upon a forward movement of the hollow shaft 15 are urged by the spring force into radial recesses 24 located therein and accordingly release the connection. A locking ring 25 allows that after a complete disconnection of the screw joint the shearing tool 12 can be drawn out together with the central mandrel 2. The inserting of a different or exchanged, respectively, central mandrel 2 together with a shearing tool 12 proceeds according to corresponding procedure and in which the drive motor 21 is operated in the opposite direction of rotation.

The central mandrel 2 defines together with the shearing tool 12 insofar a structural unit as they define together the shaping jaws such as can be clearly seen from FIG. 2. The shearing tool 12 is provided with guiding projections 26 located at the shearing head, which guiding projections 26 form a part of the shaping jaws and are adjusted to their radius of curvature.

The radial location of the bending mandrel 3 must also be adjusted to mentioned radius of curvature, i.e. the diameter of the bar. An increasing bending radius leads to an increasing distance of the bending mandrel from the center. It is now decisive that also the position of the bending mandrel 3 can speedily be adjusted to the prevailing conditions. To this end a plurality of threaded holes 27 is located at varying radii (see FIG. 2) in the mounting plate 6 to form mounting points for said mandrel and the bending table 4 is provided with corresponding openings 28 (FIG. 3). These openings 28 are covered by a cover plate 29 whereby one is left uncovered. The cover plate 29 is provided with one radially extending slot 30, and the bending mandrel 3 projects in any chosen radial position through this slot 30. Furthermore, the cover plate 29 is freely rotatable relative to the bending table 4. A metal plate which influences or operates, respectively, proximity switches 32, 33 is used with a position control element 31 and is located in the area of the radially extending slot 30. Two proximity switches 32 are used to set the two initial angular positions of the bending mandrel 3 and are located within the wire feed means behind the central mandrel and at both sides, respectively, of the wire feed means, and two further proximity switches 33 are located for safety purposes at both sides of the wire feed channel. The changing or adjustment, respectively, of the radial position of the bending mandrel 3 proceeds in that after having removed the bending mandrel the cover plate 29 will be aligned with the suitable threaded hole 27 in the mounting plate and thereafter the bending mandrel will be screwed back in at the corresponding location. With this procedure the position control element 31 will be aligned always again with the new position of the bending mandrel and accordingly, it can again automatically be brought by the proximity switches 32 into the correct initial positions such that no new adjustment of the apparatus will be necessary.

Figure 4:
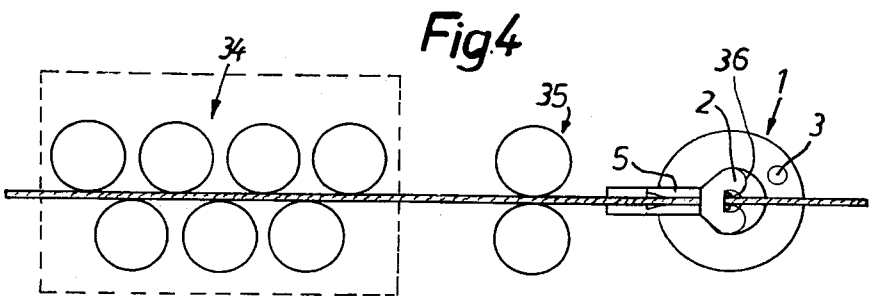
FIG. 4 is a schematic view of a bending table having a straightening and measuring means.
Figures 5A, 5B, 5C, 5D, 5E, 5F, 6A, 6B, 6C, 6D, 6E, 6F:
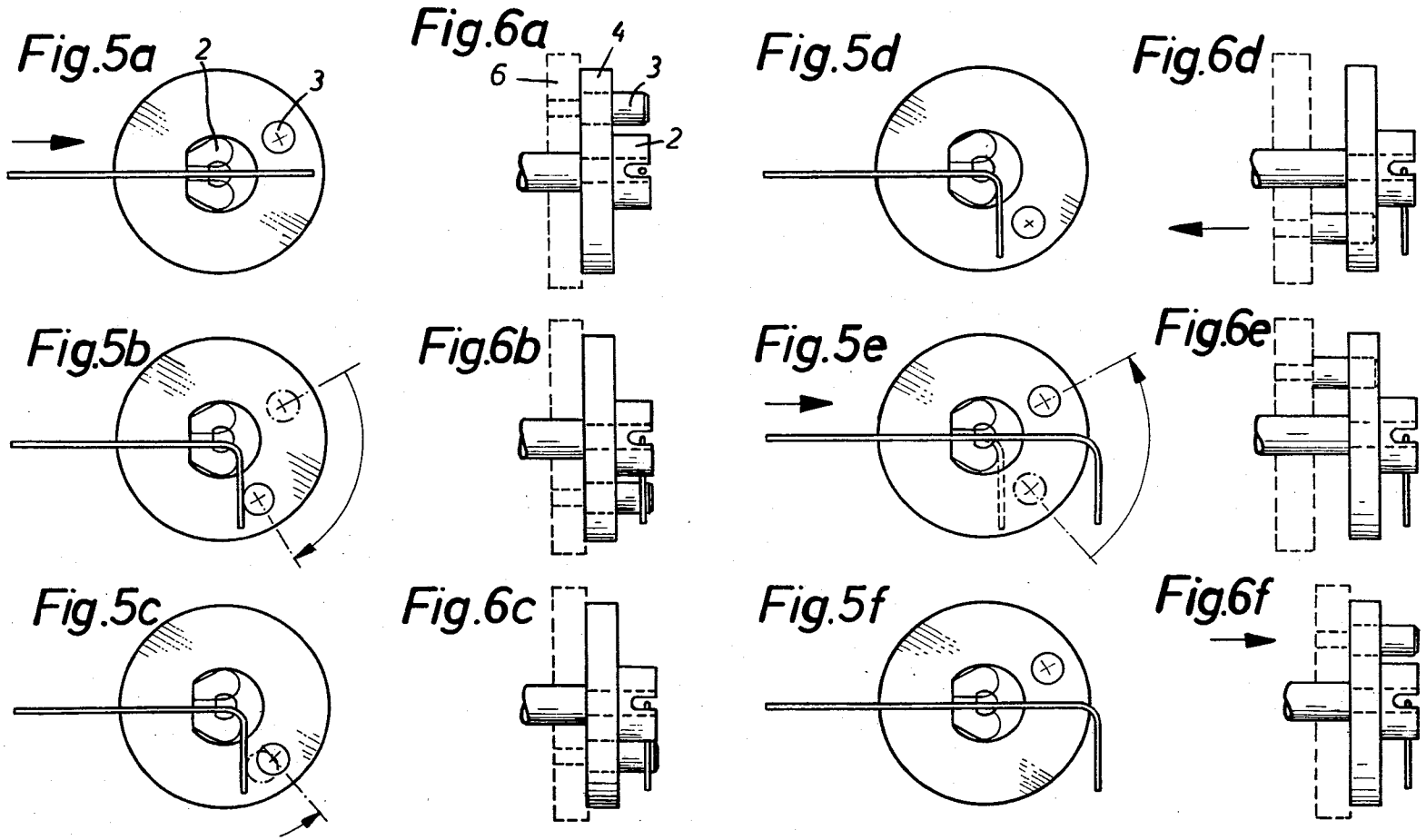
FIGS. 5*a* to 5*i* and 5*k* to 5*x* (there is no FIG. 5*j*) schematically illustrate the individual phases of an exemplary bending operation shown in plan view.
FIGS. 6*a* to 6*i* and 6*k* to 6*x* (there is no FIG. 6*j*) illustrate in side elevation the same phases as shown in FIGS. 5*a* to 5*i* and 5*k* to 5*x*.
Figures 5G, 5H, 5I, 5K, 5L, 5M, 6G, 6H, 6I, 6K, 6L, 6M:
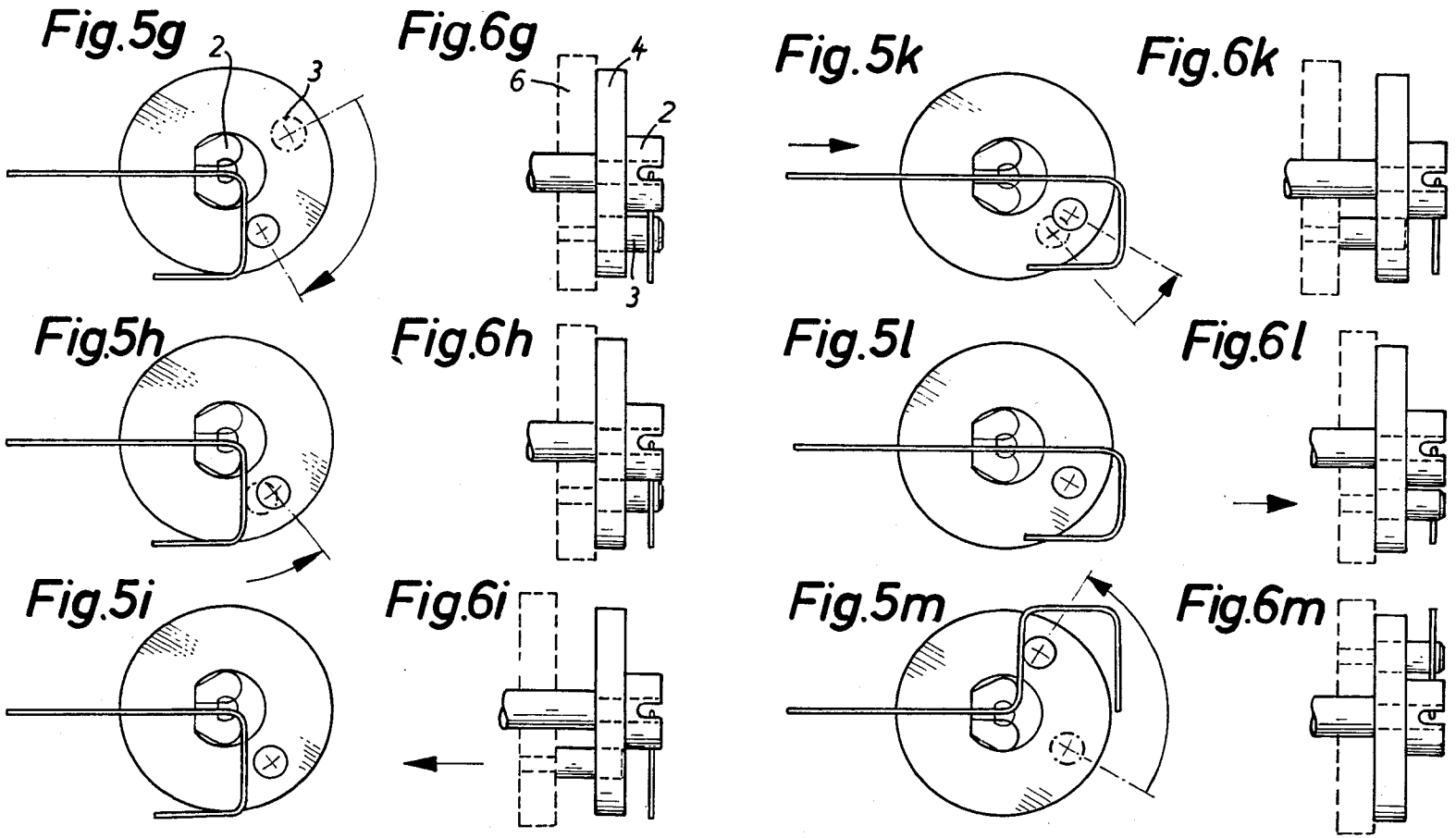
Figures 5N, 5O, 5P, 5Q, 5R, 5S, 6N, 6O, 6P, 6Q, 6R, 6S:
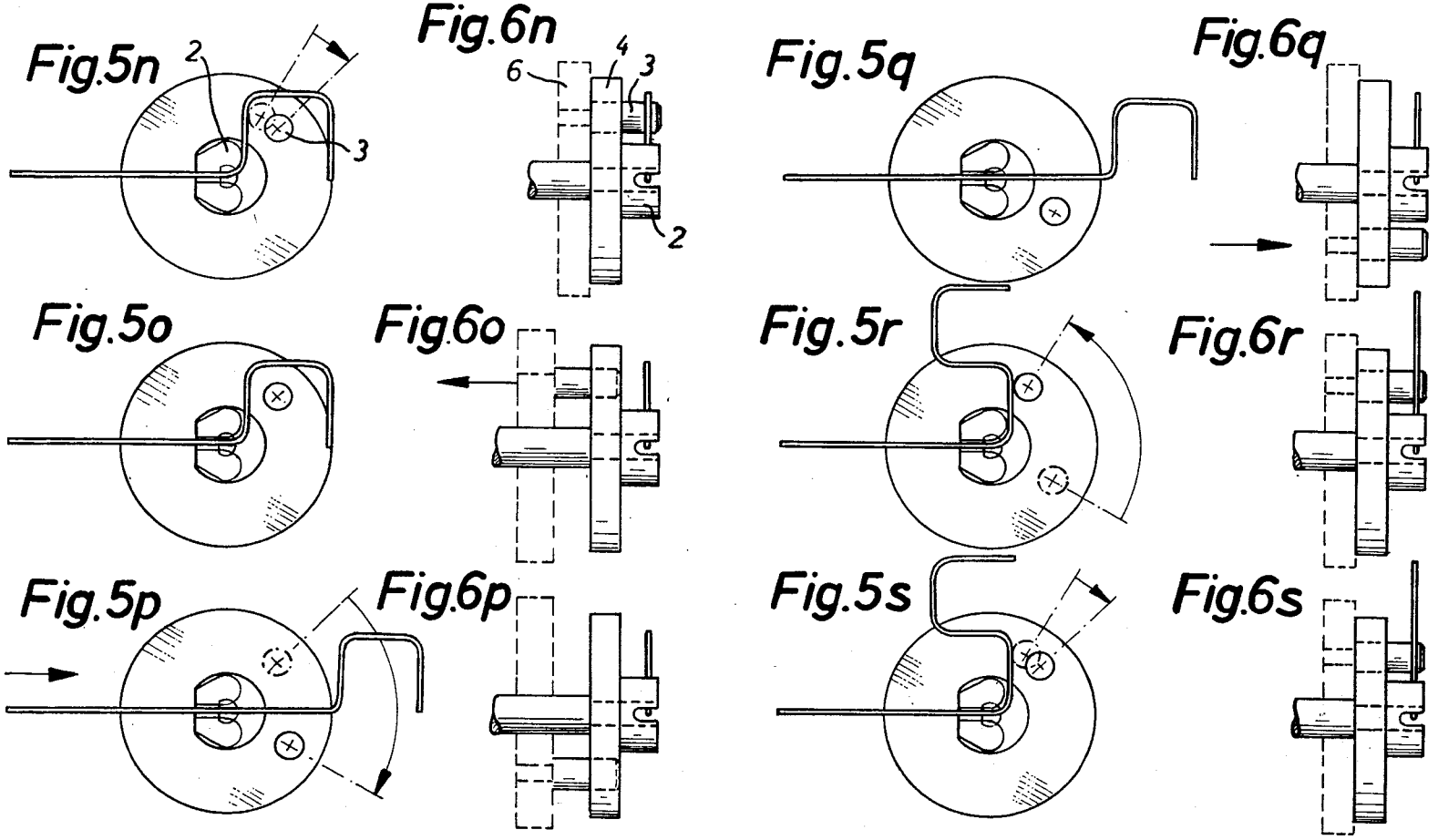

The operation of above described apparatus will be explained below with reference to FIGS. 4 and 5. According to FIG. 4 a straightening and feed apparatus 34 which is shown schematically only and which comprises a plurality of rollers is located ahead of the bending and shearing means 1. This straightening and feed apparatus 34 straightens the wire pulled off the roll and feeds this wire appropriately. A length measuring apparatus having feeler rollers is located after the straightening and feed apparatus seen in direction of wire feed. This length measuring apparatus determines the exact feed distance for the control devices of the apparatus. The length of the legs, bent sections etc. of, for instance, a wire bracket are determined exclusively by the extent of feed such as shown in detail in FIGS. 5*a* to 5*x* depicting the individual phases of a typical operation sequence for shaping a S-shaped bracket. It is to be understood that although the following explanation refers to FIGS. 5*a* through 5*x*, the FIGS. 6*a* to 6*x* show the corresponding operations in side elevation. According to FIG. 5*a* a wire feed step (in direction of the arrow) is initially made. The dimension of the feed distance must exceed the distance between central mandrel 2 and bending mandrel 3. The latter is located, for instance, at the upper of its two mentioned initial positions and accordingly is set for a bending proceeding in a clockwise direction. This bending proceeds such as shown in FIG. 5*b* at an angle of 90°. Thereafter (FIG. 5*c*) the bending mandrel will be rotated back by a small angle such to move out of contact with the wire, which wire obviously due to the inherent elasticity exerts an elastic spring force onto the central mandrel, such that after having been moved out of contact with the wire the mandrel can be returned without being subject to friction from the operating position into the retracted position (FIG. 5*d*). According to FIG. 5*e* this is followed by a wire feed step and a simultaneous moving back of the retracted bending mandrel into its upper initial position. Due to the fact, that the wire feed and returning movement of the mandrel are carried out simultaneously, which returning movement of the retracted bending mandrel is to be carried out in the retracted position thereof only, it is possible to shorten the operating time somewhat. After the bending mandrel 3 has reached its upper initial position, it will be once more extended into its operating position (FIG. 5*f*) and accordingly, it is ready for carrying out the subsequent bending operation (FIG. 5*g*) proceeding in a clockwise direction. After this bending operation has been terminated, the wire will again be released (FIG. 5*h*) and the bending mandrel once more retracted (FIG. 5*i*). It is assumed that the subsequent bending operation must proceed in the opposite direction and accordingly the bending mandrel will be rotated during the next wire feed step into its lower initial position (FIG. 5*k*), and thereafter the bending mandrel will once more be extended into its operating position and thereafter the wire will be bent by 90° in a counterclockwise direction such as shown in FIGS. 5*l* and 5*m*. After this bending procedure the sequence is repeated: Releasing, retracting and returning in an (the lower) initial position and simultaneous wire feed (FIGS. 5*n* to 5*p*). The following steps intended to carry out a further bending directed counterclockwise proceed again in accordance with the above explained procedure, namely: Extending of the bending mandrel, bending by 90°, setting the wire free (FIGS. 5*q* to 5*s*). Thereafter, a further retraction of the bending mandrel (FIG. 5*t*) and further wire feed step at a simultaneous returning of the bending mandrel in its (upper) initial position is carried out (FIG. 5*u*).

Figures 5T, 5U, 5V, 5W, 5X, 6T, 6U, 6V, 6W, 6X:
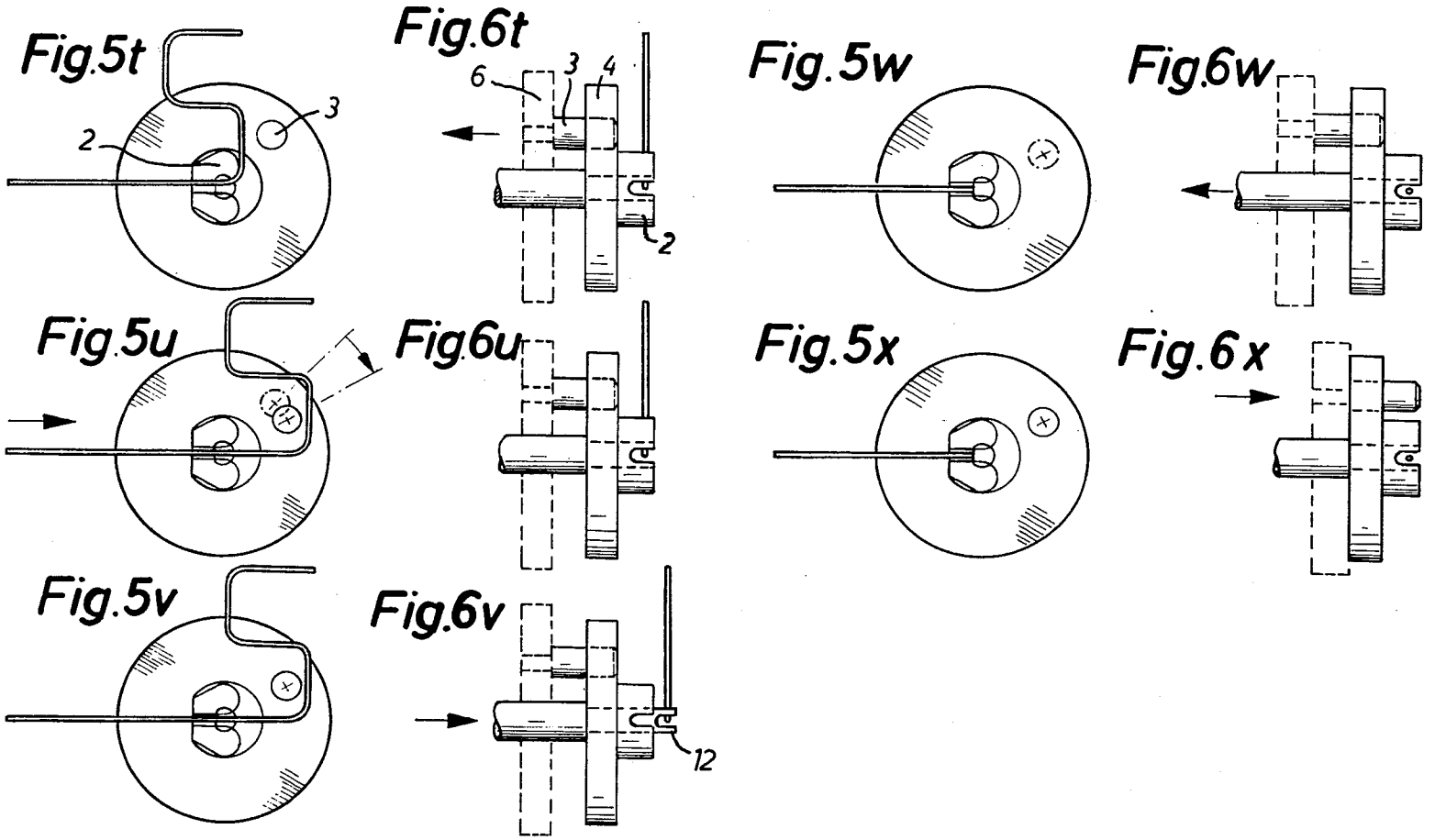

Thereafter, the shearing and ejection means 10 is operated as shown in FIG. 5*v* to separate the finished bracket from the residual wire following the previous step and after the requested wire feed step which as already mentioned is controlled by the length measuring apparatus, specifically the feeder rolls 35. The sequence is terminated by a retracting of the shearing head (FIG. 5*w*) and retracting of the bending mandrel (FIG. 5*x*).

According to above description the wire is preferably released after every bending operation (FIGS. 5*c, h, n* etc.), whereafter the retracted bending mandrel is returned into one of its two initial positions at a simultaneous feeding of the wire, which positions are determined by the subsequent bending direction. Quite importantly it must be noted that these initial positions will be maintained also after an exchanging of the central mandrel 2 and the shearing means 10 as well as after a changing of the location of the bending mandrel 3 such that no further or new, respectively, adjustment is necessary.

The sequence may, however, be simplified by deleting step 5*c* (and corresponding steps), i.e. that the moving out of contact and retracting proceed simultaneously. In the same manner, step 5*e* may be divided into two separate steps, namely firstly the wire feed and thereafter the rotating of the bending table.

The described arrangement allows a speedy adjusting of the apparatus to a given wire material. This allows a considerable increase of the operating efficiency.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. An improved wire-bending apparatus including a central mandrel which is intended to control the axis of the bends and the radius of curvature of the bent wire, including further a shearing means located within said central mandrel and a retractable and extendable bending mandrel movable by means of a bending table along a circular curve extending around said central mandrel, wherein said central mandrel and said shearing means form together an exchangeable unit such to cope with various wire cross sections and various radii of curvature.

2. The improved wire-bending apparatus of claim 1, in which the radial position of said bending mandrel on said bending plate is adjustable, wherein said bending table is provided with a plurality of openings for receipt of said bending mandrel, which said openings are distributed in said bending table at various radial distances, and wherein there is provided relative thereto an axially displaceable mounting plate provided with a plurality of corresponding mounting points for said bending mandrel.

3. The improved wire-bending apparatus of claim 2, wherein a cover plate having a radially extending opening for said bending mandrel is located on said bending table, which said cover plate comprises a position control element, and wherein there is provided at least one stationary sensor for the determination of the angular position of said bending mandrel, which said stationary sensor is responsive to said position control element.

4. The improved wire-bending apparatus of claim 2, comprising at least two stationary sensors for the respective determination of an initial angular position of said bending mandrel, which said stationary sensors are located at both sides of a feeding means and after said central mandrel seen in the direction of the wire feed.

5. The improved wire-bending apparatus of claim 1, wherein said center mandrel is provided with a hollow shaft located at rear thereof, which said hollow shaft is mounted on a rotatably supported coaxial supporting shaft, which said supporting shaft is rotatable around its axis for a disconnecting and locking, respectively, of said center mandrel such that said center mandrel is exchangeable at its front side.

6. The improved wire-bending apparatus of claim 5, wherein said central mandrel is supported by a stationary wire feeding channel in a nonrotatable, however axially movable fashion.

7. The improved wire-bending apparatus of claim movable 5, wherein said shearing means comprises an axially shearing tool extending within said hollow shaft and having a shearing head intended to cooperate with said central mandrel and mounted to an operating shaft such that it disconnects itself therefrom automatically upon a disconnecting of said central mandrel.

8. The improved wire-bending apparatus of claim 7, wherein said shearing head is structured as a shearing knife having laterally arranged guide projections and cooperates with a sleeve structured as counter knife and located inside said center mandrel, whereby said guide projections define together with said center mandrel two shaping jaws, of which each determines one bending axis for one bending direction.

* * * * *